United States Patent [19]

Nakata et al.

[11] Patent Number: 4,653,098

[45] Date of Patent: Mar. 24, 1987

[54] METHOD AND APPARATUS FOR EXTRACTING SPEECH PITCH

[75] Inventors: Kazuo Nakata, Kodaira; Takanori Miyamoto, Kokubunji, both of Japan

[73] Assignee: Hitachi, Ltd., Tokyo, Japan

[21] Appl. No.: 462,422

[22] Filed: Jan. 31, 1983

[30] Foreign Application Priority Data

Feb. 15, 1982 [JP] Japan ..... 57-21124

[51] Int. Cl.[4] ..... G10L 5/00

[52] U.S. Cl. ..... 381/49

[58] Field of Search ..... 381/38, 47, 49, 36, 381/37, 38, 39, 40, 41, 42, 43, 44, 45, 46, 47, 48, 49, 50; 371/31; 364/513.5, 513

[56] References Cited

U.S. PATENT DOCUMENTS

| | | | |
|---|---|---|---|
| 3,740,476 | 6/1973 | Atal | 381/49 |
| 3,852,535 | 12/1974 | Zurcher | 381/49 |
| 3,947,638 | 5/1976 | Blankinship | 381/49 |
| 4,004,096 | 1/1977 | Bauer et al. | 381/49 |

*Primary Examiner*—E. S. Matt Kemeny

*Attorney, Agent, or Firm*—Antonelli, Terry & Wands

[57] ABSTRACT

A plurality of pitch period candidates are selected from a peak of correlation of a speech waveform in a current frame from which a pitch period is to be extracted, and a speech pitch is selected from the candidates by referring to a guide index which is precalculated based on pitch periods extracted in past frames. The guide index is an average of the pitch periods in the past frames.

7 Claims, 11 Drawing Figures

METHOD AND APPARATUS FOR EXTRACTING SPEECH PITCH

BACKGROUND OF THE INVENTION

1. Field of the Invention

The present invention relates to method and apparatus for extracting a pitch period (or a reciprocal thereof, that is, pitch frequency) in speech analysis, and more particularly to a method and apparatus for extracting speech pitch suitable for real time analysis.

Description of the Prior Art

Significance of pitch period extraction which is a main portion of sound source information in extracting information in a speech compression system or speech analysis-synthesis has been experimentarily recognized since the invention of the vocoder in 1939 (The Vocoder by H. Dudley, Bell Labs. Record, 17, 122–126, 1939). A number of investigations and experiments have been reported on the pitch period extraction method since Dudley's invention. A representative one of them is reported by "Speech Analysis" (IEEE Press, John Wiley Sons Inc. 1978), Part III, Estimation of Excitation Parameters, A Pitch and Voicing Estimation, which is one of IEEE Press Selected Reprint Series edited by R. W. Schafer and J. D. Markel. However, a decisive pitch extraction method has not been established yet and investigation and experiment reports have been continuously contributed to domestic and foreign associations.

As a so-called linear prediction analysis and synthesis method has been recently researched and developed and a speech synthesis LSI has been realized, the need for the pitch extraction method has further increased and the establishment of reliable pitch extraction method in the real time analysis is a significant point to improve the tone quality of transmitted or synthesized sound and the significance thereof is increasing to an even greater extent.

Most of prior art approaches to the improvement of the pitch extraction method are mainly directed to off-line analysis and they are not always suited to real time analysis.

In pitch extraction, a $\frac{1}{2}$, $\frac{1}{3}$, double or triple period is often detected. The difficulty in pitch extraction resides in a specific manner of determination thereof and a specific manner of maintaining the continuity of the extracted result. A beginning of a word or an ending of a word generally has a small amplitude and the pitch period thereof is not always definite. Nevertheless, in the real time analysis a process has to be started from an ambiguous state.

However the pitch extraction method is improved, it is difficult to completely resolve the above problem and some countermeasurement is needed in processing the extracted result.

In the real time analysis, it is not permitted to start the process after the pitch has been positively extracted or the analysis has been completed. This adds a further difficulty.

The prior art approaches to the above problems are not always sufficient. Most approaches have disadvantages in that the process is started after data and information have been stored.

SUMMARY OF THE INVENTION

It is an object of the present invention to provide a method for extracting a pitch period in a real time analysis of speech with a minimum memory capacity and a minimum time delay.

In order to achieve the above object, in accordance with the present invention, the pitch period in a current frame is determined by using a pitch period in a past frame as a guide index.

DESCRIPTION OF THE PREFERRED EMBODIMENTS

Figure 1:
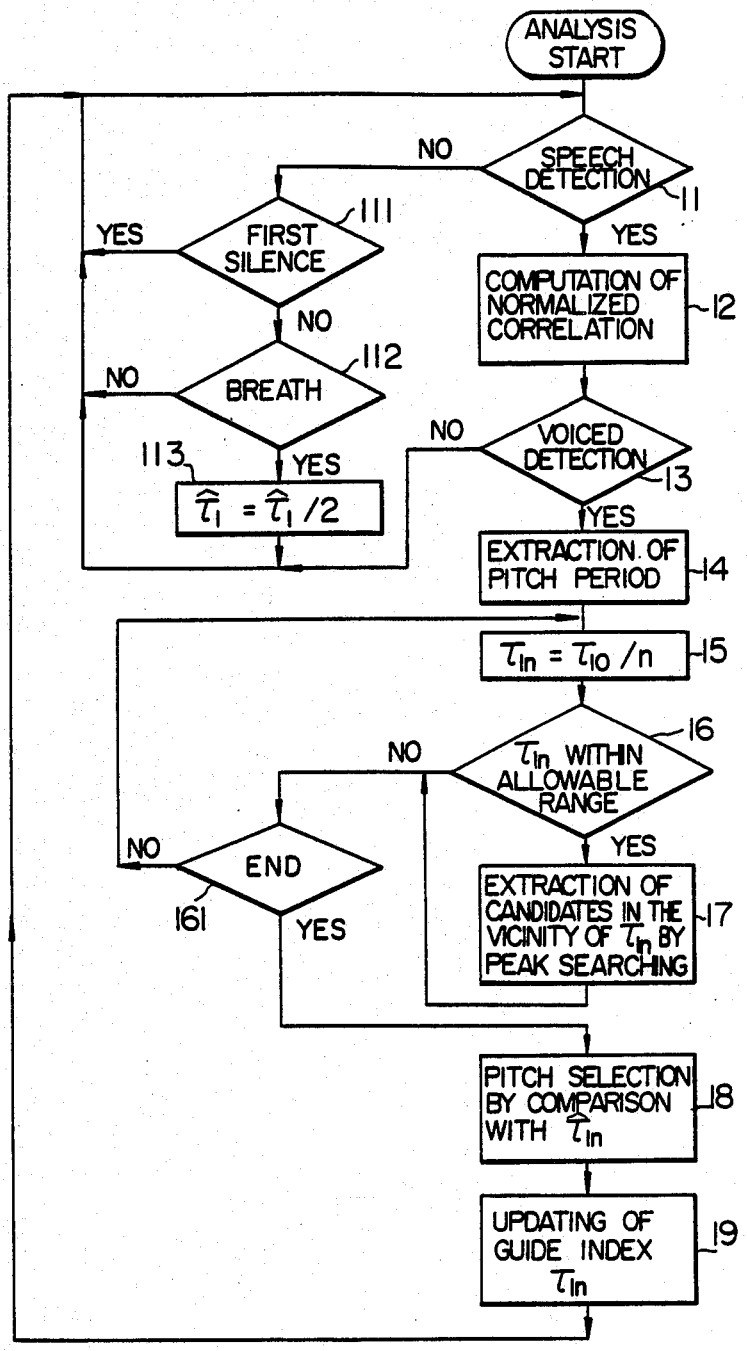
FIG. 1 shows a flow chart of pitch extraction processing for explaining the principle of the present invention.

Difficulties of the pitch extraction in the real time analysis are summarized as follows.

(1) The extraction by mere maximum correlation has a high probability of misextracting $\frac{1}{2}$, $\frac{1}{3}$, double or triple period.

(2) As a result, the continuity of the pitch period is not maintained and the pitch period varies over a wide range.

(3) The extraction of pitch at the beginning of a word or the ending of a word is particularly hard.

(4) Since regions of pitch periods of a male voice and a female voice are overlapped, when a speech including a mixture of the male voice and the female voice is to be analyzed, it is difficult to instantaneously discriminate the male voice or the female voice at a switching time of those voices.

In order to overcome the above difficulties, the present invention extracts the pitch in the following manner.

(1) If $\frac{1}{2}$, $\frac{1}{3}$, double or triple of the pitch period detected as a time delay required for a maximum correlation is within a range permitted to the pitch period, for example between 20 milliseconds (=50 Hz; lowest pitch of the male voice) and 2 milliseconds (=500 Hz; highest pitch of the female voice), it is checked if a peak of the correlation exists nearby, and if it exists, a pitch extracted therefrom is also selected as a candidate of the pitch period.

(2) In order to select one pitch period from a plurality of extracted pitch period candidates, a smoothened average of the past pitch periods is calculated and it is used as a guide index for the selection. That is, one of the pitch periods which is closest to the guide index is selected.

Assuming that $\{\tau_i\}$ (i=0, −1, . . . , −n, . . . ) is the pitch period extracted at the past time point i and the present time point is represented by i=1, the guide index $\tau_1$ is defined as follows.

$$\tau_1 = K\tau_0 + (1-k)\tau_0 \quad (1)$$

where k is a constant and $0<k<1$, $\tau_0$ is a pitch period extract in the immediately preceding frame and $\tau_0$ is a guide index therefor.

(3) Where the speech is breathed at a boundary of words, $\tau_1$ is $\frac{1}{2}$ of $\tau_0$ before breathing. This is due to the fact that a pitch period pattern in one breath shifts in V shape and is discontinuous at an entry of a new breath and hence $\tau_0$ is too large to be the guide index.

If an analysis section is unvoiced or silent and includes no pitch period, the guide index is kept unchanged.

The breathing point is determined by detecting that a section which has a small speech amplitude and is regarded as silence continues for a certain time period, for example, 100 milliseconds to 500 milliseconds.

(4) Since a pitch period extraction error is large at the beginning of the speech, a criterion for determining voiced speech (for example, an input amplitude exceeds a threshold $\theta_V$ and a peak of normalized correlation is larger than $\theta_P$) is made severe (for example, $\theta_{V0}=2\theta_V$, $\theta_{P0}=2\theta_P$) and extracted pitch in a positive voiced section is initialized. Once the beginning of the speech has been determined, those threshold values are returned to the normal values, for example, $\frac{1}{2}$ of the values at the beginning ($\theta_V=\frac{1}{2}\theta_{V0}$, $\theta_P=\frac{1}{2}\theta_{P0}$).

The above description is illustrated in a flow chart of FIG. 1.

In FIG. 1, when a speech is detected by the initial threshold value $\theta_{V0}$ for the input speech amplitude in a step 11, $\theta_{V0}$ is changed to the normal value $\theta_V$ and a voiced speech is detected in a step 13 by the initial threshold $\theta_{P0}$ for the peak of the normalized correlation $\{\gamma_i\}$ ($i=\tau_{min}\sim\tau_{max}$) computed in a step 12 from the speech signal.

When the voiced speech is detected, $\theta_{P0}$ is changed to the normal $\theta_P$ and a first candidate ($\tau_{10}$) for the pitch period is extracted in a step 14. In a step 15, $\tau_{1n}$ (n =3, 2, $\frac{1}{2}$, $\frac{1}{3}$) are computed. If the voiced speech is not detected, the process returns to the step 11.

In a step 16, it is checked if $\tau_{1n}$ is within an allowable pitch period range (for example, 50 Hz∼500 Hz) or not, and if it is within the allowable range, pitch periods $\tau'_{1n}$ (n=3, 2, 1, $\frac{1}{2}$, $\frac{1}{3}$) which are in the vicinity of $\tau_{1n}$ including $\tau_{10}$ are sequentially extracted by peak searching as second, third, . . . candidates in a step 17.

On the other hand, if $\tau_{1n}$ is not within the allowable range, it is checked if the voiced speech has terminated in a step 161, and if it has not been terminated, the steps 15 and 16 are repeated for the next $\tau_{1n}$. If it has been terminated, a pitch period $\tau_1$ which is within the range defined by the guide index $\tau_1$ when calculated in accordance with the formula (1) (for example, $\tau'_{1n}$ which is closest to $\tau_1$) is selected as a current period in a step 18.

In a step 19, $\tau_2$ is calculated from $\tau_1$ and $\tau_1$ in accordance with a formula $$\tau_2 = k\tau_1 + (1-k)\tau_1 \quad (2)$$

and it is selected as a new $\tau_1$ to update the guide index. Then, the process returns to the step 11.

If the voiced speech is not detected in the step 11, the speech is checked for the first silence in a step 111, and if it is not, the speech is checked for a breath in a step 112, and if it is a breath, $\tau_1$ is multiplied by $\frac{1}{2}$ in a step 113 and the process returns to the step 11. The end of the analysis process is instructed externally.

The extraction of the pitch period in the speech which is mixture of a male voice and a female voice is now explained.

If the male voice and the female voice cannot be discriminated, the guide index is reset at a break of a sentence at which the switching between the male voice and the female voice may possibly occur (which is detected by a silence period (pause) of longer than a certain period). In order to avoid an error at the beginning of a word after reset, the criterion to determine the voiced speech at the beginning of the word should be severe. As a result, the beginning of the word is excessively silenced causing degradation of the tone quality.

It is not possible to resolve the above problem by a full real time processing (in which decision is made within a current frame based on past information and information in the current frame).

In the prior art off-line analysis method in which the pitch extraction is corrected after the analysis for one word, phrase or sentence has been completed, the transmission of the speech information by real time analysis and synthesis needs too large a memory capacity and includes too long a time delay, and hence the prior art method is not practical. In the present invention, the pitch extraction at the beginning of a word is assured with a minimum time delay and a minimum memory capacity in the following manner.

The speech analysis is generally effected at every 10 to 20 milliseconds based on 20 to 30 milliseconds long data. Judging from various analysis results, the error in the pitch extraction at the beginning of word occurs in the first 50 milliseconds and the vocal chords vibration is steady thereafter and the pitch period is generally correctly extracted thereafter.

Thus, when the beginning of the voiced speech at the beginning of a word is detected, the analysis data within 100 milliseconds thereafter, for example, is temporarily stored and an average thereof is set as an initial candidate for the guide index at the beginning of the word.

In accordance with an experiment made by the inventors of the present invention, averaging over at least eight frames for the analysis at 10 milliseconds interval and at least four frames for the analysis at 20 milliseconds interval are required.

The principle of the pitch extraction at the beginning of a word will now be explained for specific data. Let us assume that the following pitches were extracted at the beginning of a word (for the analysis of 20 milliseconds interval).

| Frame Order | Frame Number | Pitch Period (by 8 KHz clock) |
|---|---|---|
| 1 | 453 | 84 |
| 2 | 455 | 28 |
| 3 | 457 | 31 |
| 4 | 459 | 60 |
| 5 | 461 | 29 |

This is a female sound and an average pitch frequency is 30∼28 judging from the following data.

An average over the first four frames is first calculated.

(84+28+31+60)/4=50 (fraction is cut away).

By using the average 50 as the initial candidate for the guide index, virtual pitches are extracted sequentially starting from the first frame. The pitch period of the first frame is 84 which is larger than 50, and $\frac{1}{3}$ and $\frac{1}{2}$ thereof are 28 and 42, respectively. The closest one of 28, 42 and 84 to 50 is 42.

Thus, 42 is set as the pitch period $P_1$ of the first frame.

A ratio $R_1$ of the first candidate $P_1'$ (measured value) and the selected value $P_1$ is calculated ($R_1=P_1/P_1'$). In the present example, $R_1=42/84=\frac{1}{2}$.

Then, an average of the guide index 50 and the selected value 42 is set as a guide index for the second frame. That is, (50+42)/2=46.

This relation can be generalized as $$X_1=kX_0+(1-k)X_1\ (0<k<1)$$

when $k=\frac{1}{2}$, simple average is used as shown above. An appropriate range of k is $$0.5<k<0.75$$

In the above formula, $\overline{X}_0$ is a guide index to determine $X_1$ and $X_1$ is a value selected from double, triple, $\frac{1}{2}$ or $\frac{1}{3}$ of the measured value corrected by $\overline{X}_0$, which is closest to $\overline{X}_0$.

Since the average 46 is larger than the measured value ($P_2'=28$) of the second frame, a value out of double and triple of 28, that is, 56 and 84, and 28 which is closest to 46, that is, value 56 is selected as the pitch frequency $P_2$ of the second frame, and $R_2$ is calculated as follows. $R_2=P_2/R_2'=56/28=2$.

Similar operations are repeated so that pitch periods of 42, 56, 62 and 60 are selected and R's are set as $\frac{1}{2}$, 2, 2 and 1, respectively.

The above is summarized for the four frames of the beginning of a word as shown below.

| Frame Order | Pitch Period P' | Guide Index | Selected Value P | Ratio R = P/P' |
|---|---|---|---|---|
| 1 | 84 | 50 | 42 | $\frac{1}{2}$ |
| 2 | 28 | 46 | 56 | 2 |
| 3 | 31 | 51 | 62 | 2 |
| 4 | 60 | 56 | 60 | 1 |

Since a majority of R's is 2, the initial candidate 50 for the guide index is divided by 2 (50/2=25) and 25 is selected as a corrected initial candidate for the guide index.

By calculating the above formulas with the corrected initial candidate, the following pitches are obtained.

| Frame Order | Pitch Period P' | Guide Index | Selected Value P | Ratio R = P/P' |
|---|---|---|---|---|
| 1 | 84 | 25 | 28 | $\frac{1}{3}$ |
| 2 | 28 | 28 | 28 | 1 |
| 3 | 31 | 28 | 31 | 1 |
| 4 | 60 | 29 | 30 | $\frac{1}{2}$ |

In this manner, the pitches are extracted correctly.

This principle is based on the thinking that when most of the ratios R are 1, the average is approximately equal to the correct guide index but when a small number of N frames at the beginning of word have the ratio of R=1, the average is not adequate (too large or too small) for the guide index and the value is corrected such that many of the frames have the ratio of R=1.

Figure 2:
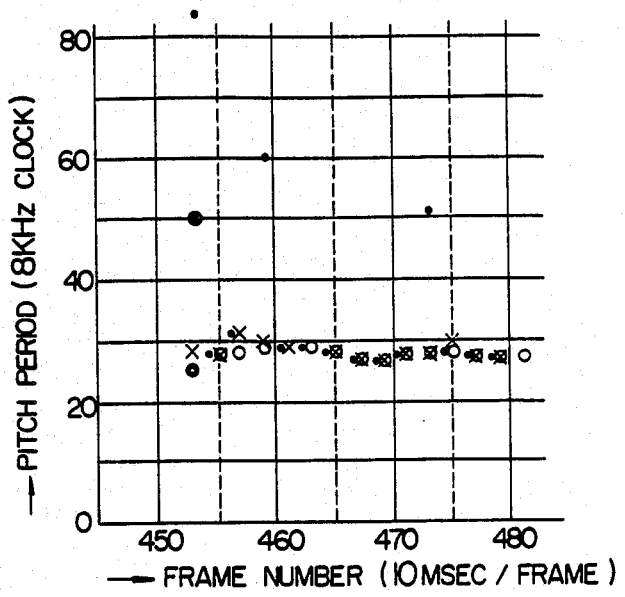
FIG. 2 shows an example of data in a process of pitch extraction at a beginning of word in accordance with the present invention.

Referring to FIG. 2, the abscissa represents the frame number at 10 milliseconds interval and the ordinate represents the pitch period represented by 8 KHz clock. Dots (·) in FIG. 2 show measured pitch periods, circled dots ( · ) show the guide indexes at the beginning of word of FIG. 1 in the first four frames (453, 455, 457 and 459), double circles ( ) show the corrected guide indexes, circles ( ) show the guide indexes to the next frames and crosses (×) show the measured pitch periods corrected by the guide indexes.

Figure 3:
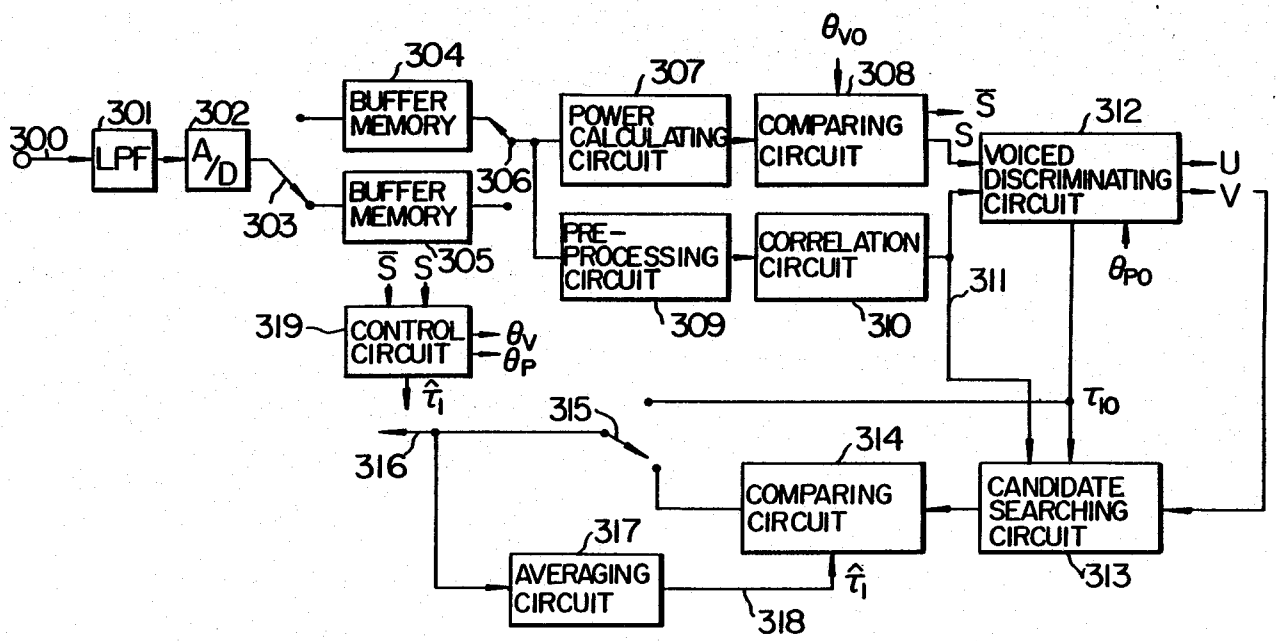
FIG. 3 shows a circuit block diagram of a first embodiment of the present invention.

FIG. 3 shows a block diagram of one embodiment of the present invention.

Referring to FIG. 3, a speech waveform 300 is appropriately low-passed by a low-pass filter 301 (for example, 3.4 KHz nominal cutoff) and then A/D-converted by an A/D converter 302 (for example, 8 KHz sampling, 10 bits including a sign bit), then switched by a switch 303 at an appropriate interval (analysis frame length, for example 30 milliseconds) and then stored in a buffer memory 304 or 305 on real time. The stored data is read out of the buffer memory 304 or 305 which is designated by a switch 306 and which completed the data storing.

The read data is supplied to a power calculation circuit 307 where a power of interframe input is calculated, and it is compared with a threshold $\theta_{V0}$ by a compare circuit 308 to discriminate a voiced S and an unvoiced $\overline{S}$. The data is also supplied from the switch 306 to a pre-processing circuit 309 where the data is pre-processed for the pitch extraction and the pre-processed data is supplied to a correlation circuit 310 where a normalized correlation coefficient sequence $\{\gamma_1\}$ is calculated. The pre-processing may be any one of known techniques for the pitch extraction such as low-pass filtering, residual by a linear prediction inverse filter or center clipping. The correlation calculation should cover an entire range in which the pitches may possibly exist and it may range from 50 Hz to 500 Hz. When the sampling frequency is 8 KHz, the 50 Hz corresponds to $8\times10^3/50=160$ sample period delay and the 500 Hz corresponds to $8\times10^3/500=16$ sample period delay. If the male voice and the female voice can be discriminated prior to the analysis, the range can be further restricted.

The normalized correlation output 311 is supplied to a voiced discriminating circuit 312 where the normalized correlation coefficient at a maximum correlation point $\tau_{max}$ other than $\tau=0$ is compared with a threshold $\theta_{P0}$ to discriminate the voiced (V) and the unvoiced (U).

When the voiced (V) is discriminated, peaks of the correlation coefficients in the vicinities of $\frac{1}{2}$, $\frac{1}{3}$, double and triple of $\tau_{10}$ are searched by a candidate searching circuit 313, and the results thereof are compared with the guide index $\tau_1$ by a compare circuit 314 so that the closest one is selected.

At the beginning of the voiced period, the pitch period $\tau_{10}$ corresponding to the maximum correlation point detected by the voiced discriminating circuit 312 is selected by the switch 315.

The extracted pitch period 316 ($\tau_{10}$) is supplied to an averaging circuit 317 where it is average with the last pitch periods to calculate an averaged guide index 318 ($\tau_1$). The guide index $\tau_1$ may be calculated in accordance with a formula $$\tau_1=k\tau_1+(1-k)\tau_1$$

If the compare circuit 308 discriminates the unvoiced $\bar{S}$ and if the unvoiced has lasted for more than 100 milliseconds in the speech period, it is regarded as a breath and the guide index $\tau_1$ is halved.

Figure 4:
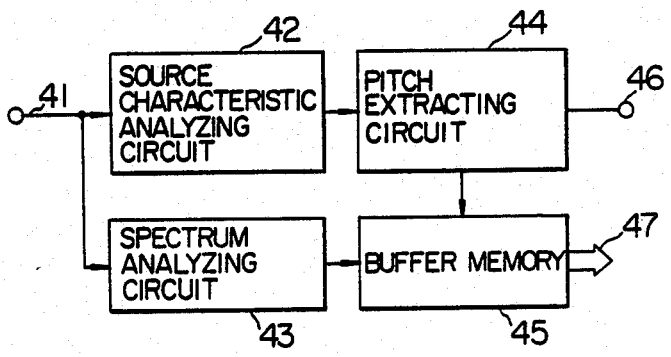
FIG. 4 shows a circuit block diagram of a second embodiment of the present invention.

FIG. 4 shows a block diagram of a pitch period extracting circuit at the beginning of a word. An input speech data 41 is supplied to a source characteistic analyzing circuit 42 and a spectrum analyzing circuit 43. Specific constructions of those circuits have been known and hence they are not explained here. Based on the analysis result for each frame from the source characteristic analyzing circuit 42, the speech period and the non-speech period are discriminated, and if the speech period is detected, a classification of voiced/unvoiced is supplied to a pitch extracting circuit 44 and if the voiced is detected, the extracted pitch frequency is supplied to the pitch extracting circuit 44. On the other hand, the spectrum analyzing circuit 43 extracts parameters representative of the spectrum characteristic such as partial auto-correlation coefficients $k_1$ to $k_P$ and they are supplied to a buffer memory 45 in synchronism with the frame.

Figure 5:
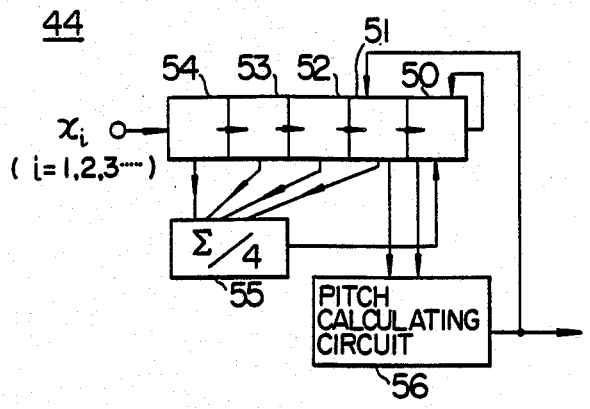
FIG. 5 shows a configuration of a pitch extraction circuit in FIG. 4.
Figure 6:
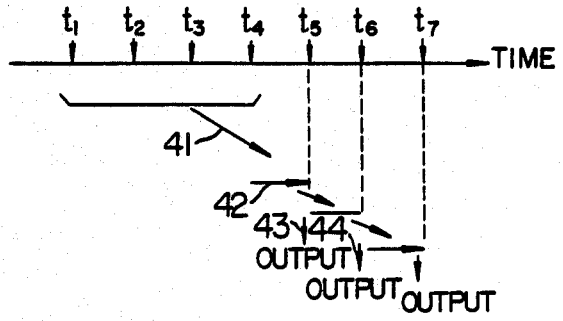
FIGS. 6 and 7(*a–d*) show a time chart for the pitch extraction processing in the circuit of FIG. 5 and a change of register contents.
Figure 7:
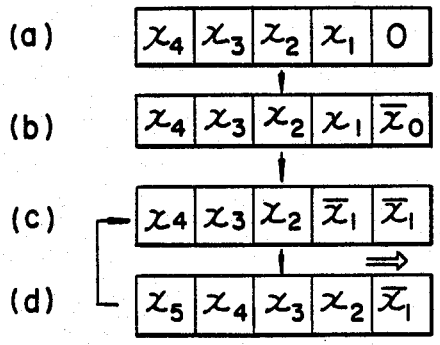
Figure 8:
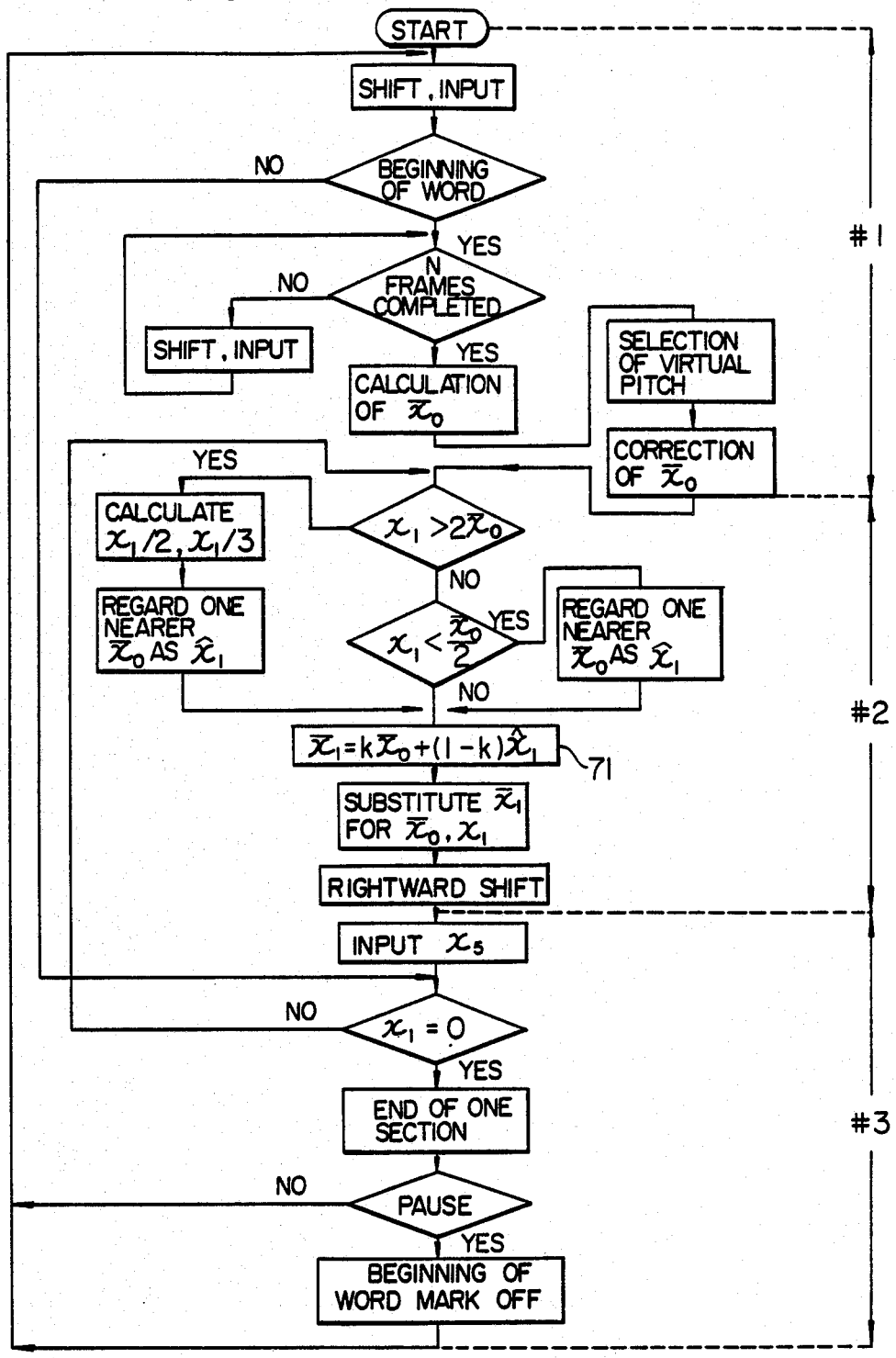
FIG. 8 shows a flow chart of the pitch extraction processing at the beginning of word in accordance with the present invention.

A construction of the pitch extracting circuit 44 is shown in FIG. 5, and a time chart of the processing in FIG. 5 and contents of registers are shown in FIGS. 6 and 7, respectively, and a processing procedure is shown in FIG. 8.

Based on input data $X_i$ (i=1, 2, 3, . . . ) to the pitch extracting circuit 44, $\bar{X}_0$ is determined, and the guide index at the beginning of a word is determined in a step #1 in FIG. 8.

Based on the input data $X_i$, it is checked if the speech is at the beginning of a word, and if it is, a beginning of word mark is set and the input data $x_1$, $x_2$, $x_3$ and $x_4$ are supplied to input registers 51, 52, 53 and 54 and sequentially shifted right therein until N (N=4 in FIG. 5 for 20 milliseconds interval analysis) data (pitch periods) are stored therein.

The four data are supplied in a time period of $t_1$ to $t_4$ shown in FIG. 6 and the contents of the registers assume as shown in FIG. 7(*a*). As shown by an arrow 41 in FIG. 6, the average $\bar{X}_0$ is calculated by an averaging circuit 55 in accordance with the following formula in a time period $t_4 \sim t_5$ and the result is supplied to the register 50.

$$\bar{x}_0 = \frac{1}{N}\left(\sum_{i=1}^{N} x_1\right) \longrightarrow \bar{X}_0 = (x_1 + x_2 + x_3 + x_4)/4$$

A virtual pitch is then extracted and $\bar{X}_0$ is corrected as required. This is effected by software in a microprocessor.

As a result, the contents of the registers assume as shown in FIG. 7(*b*).

In a step #2 of FIG. 8, $\bar{x}_1$ in a sub-step 71 is calculated by a pitch calculating circuit 56 using $\bar{X}_0$ as the guide index and it is set in the registers 50 and 51. Thus, the contents of the registers are as shown in FIG. 7(*c*).

The contents of the registers 50 to 54 are then shifted right and they are outputted at a timing of an arrow 43 of FIG. 6 by using the content $\bar{x}_1$ of the register 50 as the pitch period.

Those steps are completed in one frame shown by an arrow 42 of FIG. 6 and the process waits for the next input data $X_5$ to be supplied to the register 54. In a step #3 of FIG. 8, the following processing is carried out.

At a time $t_5$ of FIG. 6, the data $x_5$ is supplied to the register 54. If $x_1 \neq 0$, the process returns to the step #2, and $\bar{x}_0$ and $x_1$ are calculated based on $\bar{x}_1$ and $x_2$ (regarding $\bar{x}_1$ and $x_2$ as $\bar{x}_0$ and $x_1$, respectively) and they are set in the registers 50 and 51, respectively.

The contents of the registers 50 to 54 are shifted right and they are outputted at a timing of an arrow 44 of FIG. 6 by using the content $\bar{x}_1$ of the register 50 as the pitch period.

As a result, the contents of the registers are as shown in FIG. 7(*d*). The process waits for the next data input. At a time $t_6$ of FIG. 6, the data $x_6$ is supplied to the register 54.

The above steps are repeated. As a series of voices terminates and the data for $x_1$ assumes 0, a series of pitch extraction processing is terminated. Subsequently, the registers shift $\bar{x}_0$ to themselves until a pause is detected (for example, by five consecutive frames of unvoiced input) and hold the guide index for the unvoiced. When the pause is detected, the beginning of a word mark is reset and the guide index $\bar{x}_0$ is also reset.

In the above steps, $x_1$ may be outputted in place of $\bar{x}$ as the pitch period.

The data 47 which is necessary as the data for one frame such as spectrum parameters is outputted from the buffer memory 45 in synchronism with the output 46 of the pitch extracting circuit 44 in FIG. 4.

It should be understood that the above steps can be executed by software means by the microprocessor and the memory.

Figure 9:
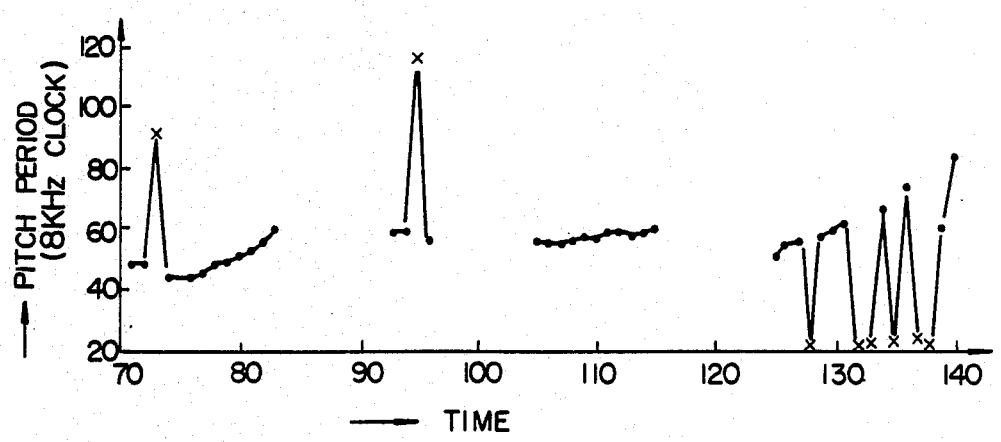
FIG. 9 shows an example of pitch extracted by a prior art method.

In FIG. 9, a time delay corresponding to a maximum correlation is simply selected as the pitch period. As shown by marks ×, errors due to $\frac{1}{2}$, $\frac{1}{3}$, double and triple of the pitch are remarkable.

Figure 10:
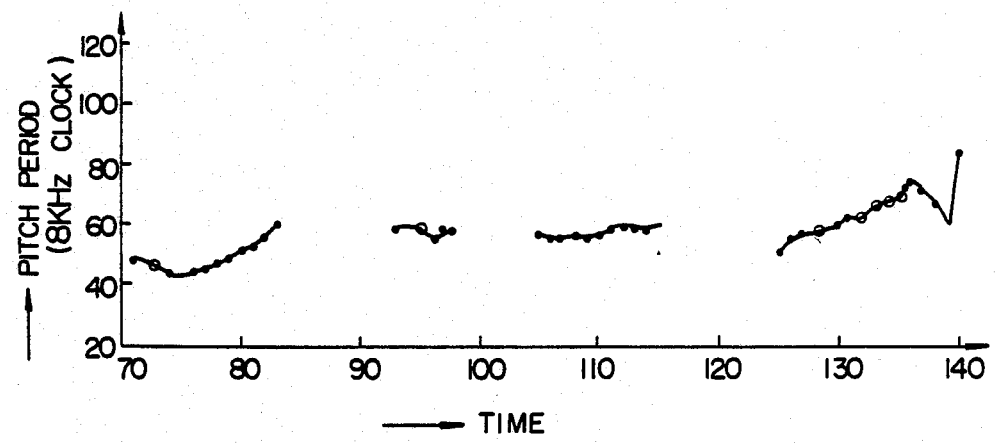
FIGS. 10 and 11 show examples of pitch extracted by the present method.

In FIG. 10, the selection from the $\frac{1}{2}$, $\frac{1}{3}$, double and triple candidates by the guide index is added to the condition of FIG. 9. The extracted pitch period well maintains the continuity. Marks · indicate the improvement of the continuity over FIG. 9.

Figure 11:
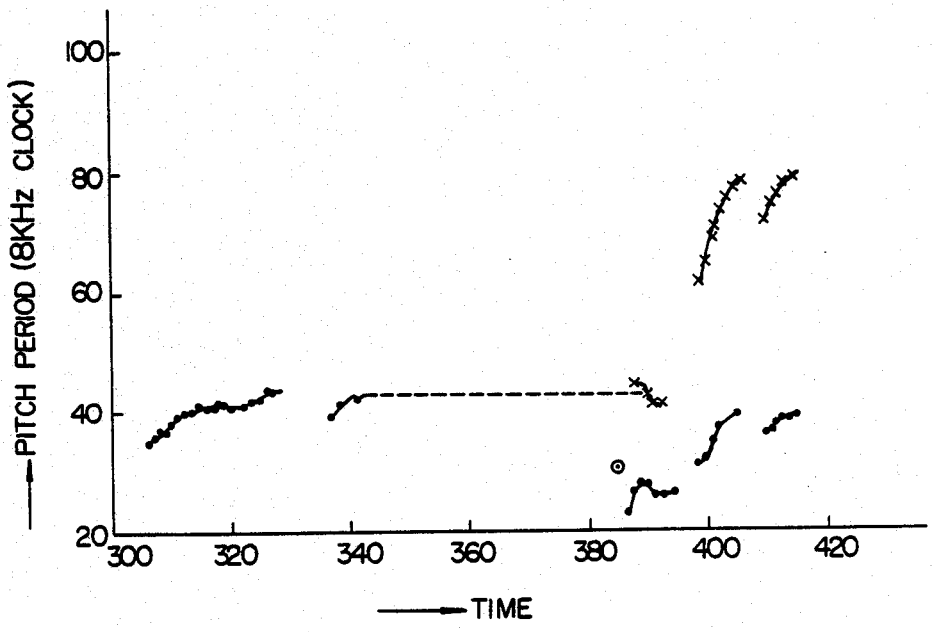

In FIG. 11, marks · indicate the addition of the reset function to the guide index in accordance with the breath, to the condition of FIG. 7. By comparing with the result (marks ×) without the reset function, it is seen that the pitch periods are in a correct range.

As described hereinabove, according to the present invention, the pitch extraction of the speech sound can be effectively carried out on a real time basis and the pitch extraction at the beginning of a word can be continuously and exactly carried out on nearly a real time basis. Accordingly, the present invention provides a significant improvement of the tone quality in the speech bandwidth compression and the speech analysis-synthesis.

What is claimed is:

1. A speech pitch extraction method for extracting a pitch period from peaks of correlation of a speech waveform, comprising the steps of:

producing a plurality of pitch period candidates from peaks of correlation in a current frame from which a pitch period is to be extracted;

calculating an average of pitch period candidates from at least one past frame, said average being used as a guide index for a current frame; and selecting as a pitch period for the current frame that one of said pitch period candidates which is closest to said guide index.

2. A speech pitch extraction method according to claim 1, wherein said average for determining said guide index $\tau_N$ is defined as $$\tau_N = k\tau_{N-1} + (1-k)\tau_{N-1}$$

where k is a constant and $0<k<1$, $\tau_{N-1}$ is a pitch period in (N−1)th frame (N: an integer no smaller than 2).

3. A speech pitch extraction method according to claim 1, wherein said produced pitch period candidates for each frame include those which correspond to n and 1/n times (n: an integer no smaller than 2) the pitch period measured for each frame and which are within a predetermined range.

4. A speech pitch extraction method according to claim 1, wherein an initial guide index at the beginning of a speech is an average of the pitch period candidates produced for a predetermined number of frames taken from said beginning of the speech.

5. A speech pitch extraction method according to claim 1, wherein said guide index is updated for a speech breath at a boundary between words.

6. A speech pitch extraction method according to claim 1, wherein said guide indices are determined by a step of calculating an average of pitch period candidates produced for each of first to N-th frames (N: an integer no smaller than 2) at the beginning of a word, as an initial guide index, a step of selecting one of a plurality of said pitch period candidates for each frame on the basis of said initial guide index and said produced pitch period candidates, a step of calculating tentative guide indices for respective frames from said initial guide index and said selected pitch period candidates and a step of modifying said initial and tentative guide indices by a correction operation determined by said initial guide index and said selected pitch period candidates, thereby providing a pitch period for each frame.

7. A speech pitch extraction method according to claim 6, wherein said correction operation includes approximation of ratios of said selected pitch period candidates to said produced pitch period candidates in the respective frames to integers and division of said initial and tentative indices by a majority among said integers.

* * * * *